US005862993A

United States Patent [19]

Bagung

[11] Patent Number: 5,862,993

[45] **Date of Patent: *Jan. 26, 1999**

[54] SLOT NOZZLE

[75] Inventor: Jorg-Olaf Bagung, Deutsch-Evern, Germany

[73] Assignee: Nordson Corporation, Westlake, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 652,365

[22] Filed: May 23, 1996

[30] Foreign Application Priority Data

May 23, 1995 [DE] Germany ..... 195 18 604.4

[51] Int. Cl.[6] ..... B05B 1/30

[52] U.S. Cl. ..... 239/455; 239/597; 239/451

[58] Field of Search ..... 239/451, 455, 239/536, 541, 597

[56] References Cited

U.S. PATENT DOCUMENTS

| | | | |
|---|---|---|---|
| 4,466,574 | 8/1984 | Dobson et al. | 239/455 |
| 4,570,859 | 2/1986 | Klett et al. | 239/455 |
| 4,960,245 | 10/1990 | Hemmat | 239/597 |
| 5,366,161 | 11/1994 | Potter et al. | 239/597 X |
| 5,370,319 | 12/1994 | Schlegel | 239/597 X |

FOREIGN PATENT DOCUMENTS

| | | |
|---|---|---|
| 61-003641A | 3/1986 | Japan . |
| 02268861A | 1/1991 | Japan . |
| 9114510A | 10/1991 | WIPO . |

*Primary Examiner*—Lesley D. Morris
*Attorney, Agent, or Firm*—Wood, Herron & Evans L.L.P.

[57] ABSTRACT

A slot nozzle having an adjustable width mouthpiece opening for applying a flowable material such as an adhesive to a surface. The nozzle has two slidable elements which are slidably displaceable with respect to each other in a predetermined direction to vary the width of the mouthpiece opening formed by the two slidable elements.

14 Claims, 7 Drawing Sheets

SLOT NOZZLE

FIELD OF THE INVENTION

This invention relates to a slot nozzle having a nozzle inlet and a mouthpiece opening.

BACKGROUND OF THE INVENTION

Slot nozzles of the afore-mentioned type serve for the areal application of different types of flowable material to various types of surfaces. Depending upon the intended purpose, e.g. dissolved or reactive synthetic resins such as polyurethane may be used as the material to be applied, but cold glue or hot-melt adhesive are also suitable. Such materials may for instance be applied for coating purposes to narrow surfaces of wood, plastic or metal profiles or as adhesive strips to films or paper surfaces.

For all applications, there is often the problem that the width in which the flowable material is to be applied varies, for instance because wood or plastic profiles of different thicknesses are to be coated, or because adhesive or color strips are to be applied in varying widths, for instance to film surfaces. Slot nozzles, the dispensing width of which is changeable, are known for such applications. It goes without saying that such slot nozzles must also be easy to dismantle and assemble and to be free of residues of adhesive or synthetic resin for cleaning purposes. In order that for instance, reactive resin does not remain in "dead water areas" of the slot nozzle until it hardens, as far as possible material should flow constantly through all channels of the slot nozzle while in use; this also applies to those channels or parts thereof which are temporarily not required when the slot width is reduced.

The requirement for dismantling ability of the slot nozzle yields the problem of imperviousness at the parting surfaces. Due to the different types of materials which are to be applied, it must first be expected that these are of low viscosity and capable of creep; however it may also be that the materials contain solvents which will attack the seals of the slot nozzle. Finally, there are a number of fields of application where what matters is that the slot nozzle is flat. Such a field of application is for instance, the gluing of edge veneers to the lateral surfaces of table leaves and the like. Often the edge veneers can be supplied to the lateral surfaces only at an obtuse angle because they break easily owing to their brittleness if the bending radius is too small when applying the edge veneer to the lateral surface to be veneered. At the same time, the adhesive should be applied as immediately as possible in the vicinity of the point at which the edge veneer and the lateral surface meet, because then fast-hardening adhesives can be used for a high production rate without there being the risk of the adhesive hardening even before the edge veneer and the lateral surface have met. Precisely when veneering the lateral surfaces of table leaves, due to the different thicknesses of the table leaves, the problem often occurs that the width of the adhesive film has to be matched to this thickness.

The object underlying the invention therefore consists in devising a slot nozzle which can be used as universally as possible, which avoids the problems discussed previously to as great an extent as possible and meets the requirements stated and is as simple as possible in construction.

SUMMARY

This object is achieved according to the invention by a slot type nozzle of the type previously described above which is distinguished in that it has two slider elements which are displaceable relative to one another in a predetermined direction (direction of displacement), each with a sliding surface, that the sliding surfaces contact each other areally, that the first sliding surface has a cutout and the second sliding surface has a projection which engages in the cutout, that the slider elements form a cavity between them which is defined by the base and by lateral surfaces of the cutout, an end face of the projection and the second sliding surface, that the surfaces of both slider elements defining the cavity lie against one another in sealing relationship, that the cavity communicates with the nozzle inlet on an outer surface of one of the slider elements, that the cavity has a slot-shaped opening on a side located parallel to the direction of displacement and between the two slider elements, which opening forms the mouthpiece opening of the slot nozzle and the dispensing width of which is adjustable by displacing the slider elements relative to each other.

FUNCTIONAL ADVANTAGES OF VARIOUS EMBODIMENTS

The central concept of the invention is that the entire cavity adjoining the mouthpiece opening of the slot nozzle is adjustable in one dimension, which means that the width of the mouthpiece opening can be adjusted. Compared with known devices, in which for instance, the mouthpiece opening of the slot nozzle can be partly closed by a slider, the device according to the present invention offers a number of advantages: the cavity and mouthpiece opening can maintain symmetry independently of their setting and in this manner ensure a uniform flow of material across the entire width of the mouthpiece opening. The construction of the slot nozzle can be very simple, and due to the flat seals between the two slider elements there are no sealing problems. The slot nozzle according to the invention is easy to dismantle and easy to clean. Furthermore, virtually any shapes of the cavity and the mouthpiece opening which communicates therewith which are desired can be produced: the two sliding surfaces may be profiled transversely to the direction of displacement of the slider elements, so that the cavity can both widen and taper in sections, as long as the two sliding surfaces lie areally against one another and are displaceable in one direction relative to each other. Finally, it is of considerable significance that the size of the cavity follows each adjustment of width of the slot nozzle exactly and automatically, so that there can be no regions therein in which material can collect.

In order to improve further a uniform flow of material in and through the cavity, one variant of the invention has a distributor space between the nozzle inlet and the cavity, which space communicates with the nozzle inlet, adjoins the cavity and the length of which in the direction of displacement corresponds to the maximum length of the cavity.

It is advantageous for the production and cleaning of the distributor space if the latter is formed by a recess starting from the cavity in one of the slider elements, the side of which is open at the maximum dispensing width is partially closed at the smaller dispensing widths.

In order that at different dispensing widths of the slot nozzle there are no "dead water areas" and material flows through the entire length of the distributor space at all dispensing widths, a feed line through which the distributor space communicates with the nozzle inlet preferably opens onto that end of the distributor space which is first covered when the slider elements are displaced relative to each other starting from their position at maximum dispensing width.

In one particular embodiment, the distributor space is formed by a recess in the second slider element and extends in the direction of displacement starting from the projection. The feed line then opens onto the end of the distributor space remote from the projection.

In an embodiment which is particularly simple to produce, the sliding surfaces and the base of the cutout are made flat and run parallel to each other. The height of the mouthpiece opening at right-angles to the direction of displacement is then constant.

In order to simplify the construction of the slot nozzle according to the invention still further, the first slider element which bears the cutout is advantageously made in one piece.

Furthermore, the first sliding surface may be rectangular in a top view and the cutout may be located in a corner of the sliding surfaces, so that the cutout has two adjoining side faces and a base and is laterally open on two abutting side faces of the first slider element.

In one Variant of the embodiment the second slider element which bears the projection consists of two partial elements. The first of these parts forms on one side part of the second sliding surface with the projection, whereas a second part of the second sliding surface is formed by the second partial element of the second slider element. The first partial element has the nozzle inlet and a groove for the distributor space which communicates therewith, which is limited on one side by a lateral surface of the second partial element.

It is of benefit to easy mounting and dismantling if the first slider element is attached by means of a pressure piece to the second slider element so as to be displaceable. By means of a threaded spindle which is likewise attached to the second slider element, and which engages in the first slider element, the latter can be displaced linearly with respect to the second slider element by turning the threaded spindle, so that the aforementioned dimension of the cavity can be set accurately in a simple manner.

DESCRIPTION OF THE DRAWINGS

The invention will now be explained with reference to the drawings by means of a diagram of an example of an embodiment and an actual structural example of an embodiment, wherein.

DESCRIPTION OF THE PREFERRED EMBODIMENTS

Figure 1:
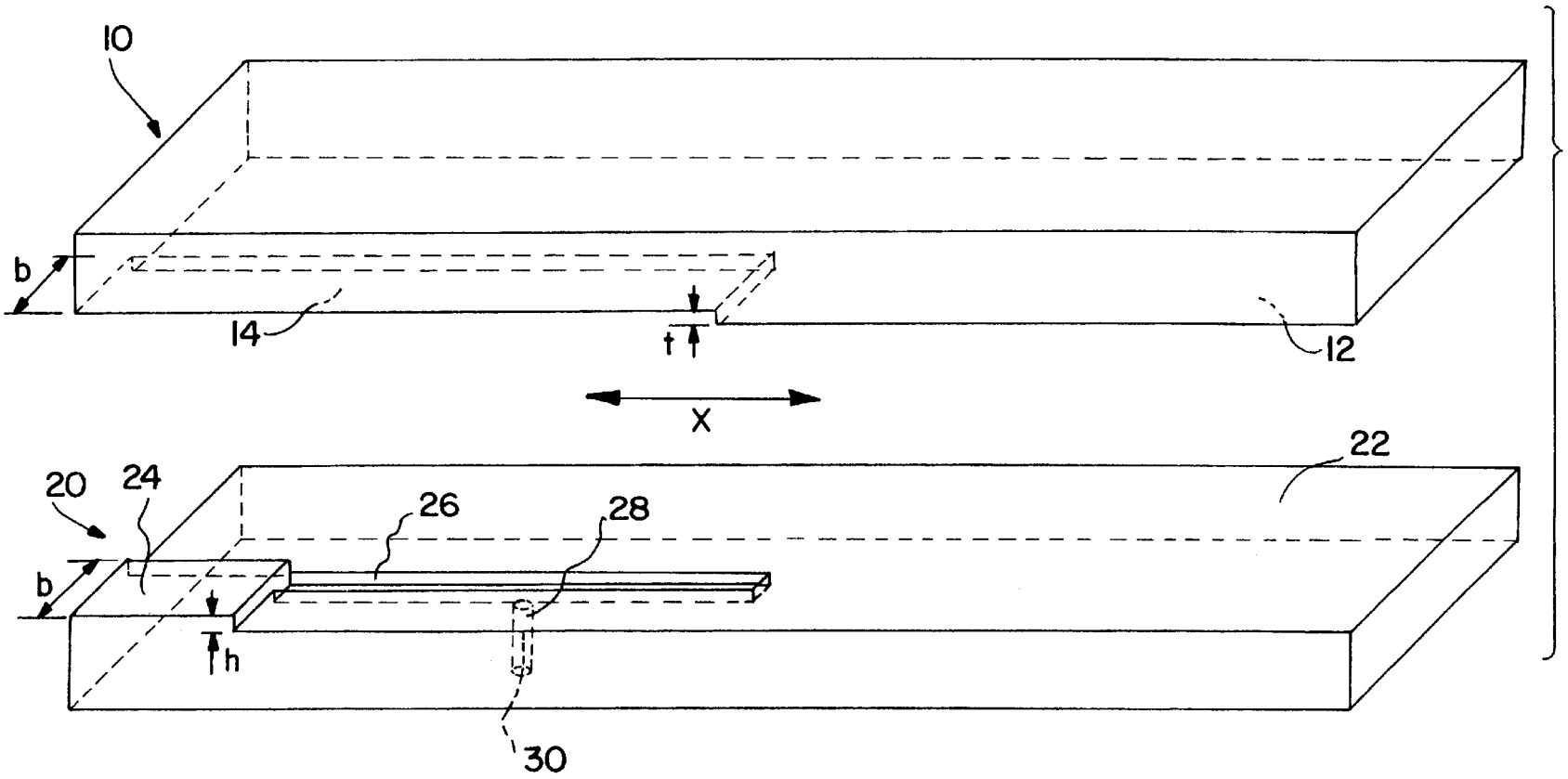
FIG. 1 shows a diagram of an exploded view of two slider elements of a simple variant of the slot nozzle.

FIG. 1 shows a diagrammatic embodiment of the slot nozzle according to the invention with a first and second slider element 10, 20 each consisting of only one piece. The two slider elements 10, 20 are designed and arranged to be displaceable relative to each other in a predetermined direction marked x in FIG. 1. The first slider element 10 has on its underside a first sliding surface 12 with a cutout 14. Both the first sliding surface 12 and the cutout 14 are rectangular. The cutout 14 begins at one corner of the base surface of the slider element 10, and is both shorter and narrower than the base surface. The depth of the cutout 14, is marked t in the drawing, and its width is marked b.

The upper side (relative to FIG. 1) of the second slider element 20 forms a second sliding surface 22. From this surface there projects in one corner a projection 24, the height h of which corresponds to the depth t of the cutout 14 of the first slider element 10. Also the width b of the projection 24 corresponds to that of the cutout 14. However, the length of the projection 24 is substantially less that the length of the cutout 14. The projection 24 is adjoined by a recess 26 in the second sliding surface 22, which is oriented parallel to the direction of displacement x and serves as a distributor space. A feed line 28 which starts from a connection opening 30 on the underside of the second slider element 20 opens into the recess 26.

Figure 2:
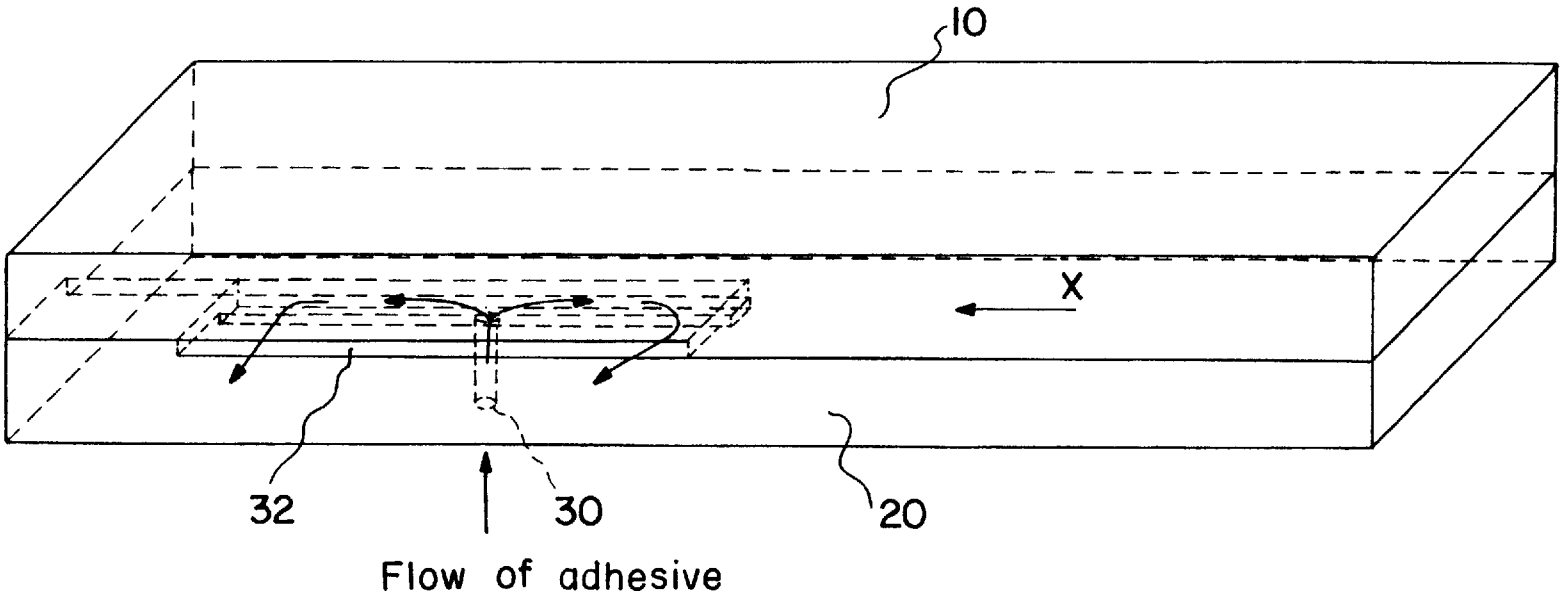
FIG. 2 shows the two slider elements of FIG. 1 in assembled form.

In FIG. 2 the first slider element 10 and the second slider element 30 of FIG. 1 are assembled to form a simple variant of the slot nozzle according to the invention. The two sliding surfaces 12 and 22 lie against one another such that a cavity is formed in the cutout 14, which cavity is sealed off by the projection 24 on one side such that it only has a slot-shaped opening on its front side (relative to FIG. 2) apart from the opening formed by the feed line 28 and the distributor space 26. This opening is the mouthpiece opening 32 of the slot nozzle.

The slot nozzle is intended for the application of adhesive. The adhesive in this case passes into the slot nozzle through the connection opening 30 on the underside thereof and passes via the feed line 28 into the distributor space 26. Then it is distributed over the entire width of the cavity and emerges from the slot nozzle at the mouthpiece opening 32.

Figure 3:
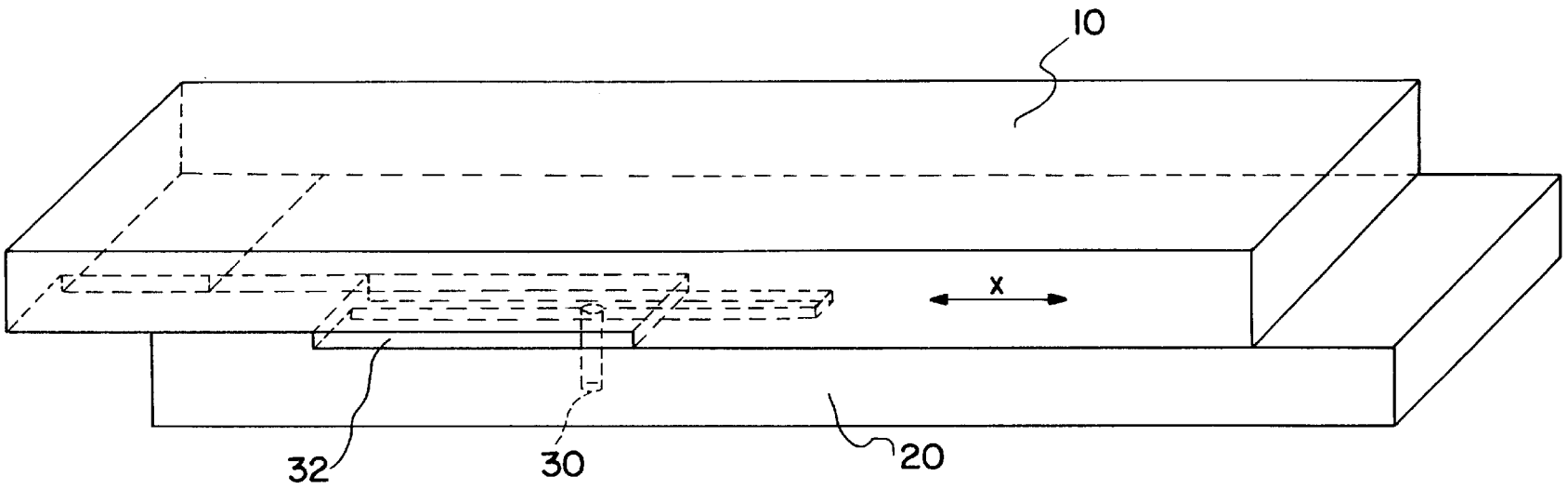
FIG. 3 shows an illustration corresponding to FIG. 2, in which the slider elements are displaced relative to each other.

In FIG. 3 the two slider elements 10 and 20 are displaced relative to each other in the longitudinal direction of the cutout 14. Both the mouthpiece opening 32 and the cavity adjoining it are thereby shortened compared with the configuration in FIG. 2. If a substrate is moved past the mouthpiece opening, in order to apply adhesive to the substrate, the width of the adhesive film, as can readily be seen from FIGS. 2 and 3, can be set by simply displacing the slider elements 10 and 20 relative to each other. In this case not only the width of the mouthpiece opening 32 decreases but also that of the cavity adjoining it. In cooperation with the distributor space 26, a uniform flow of adhesive is thus ensured.

In order that in the diagrammatic embodiment of the slot nozzle illustrated in FIGS. 2 and 3 adhesive always flows through both the feed line 28 and the distributor space 26 and also the cavity across their entire length or width, and no dead water areas occur. The feed line 28 may also open into the end of the distributor space 26 remote from the projection 24. With reference to FIGS. 2 and 3, the feed line 28 would then be located at the right-hand end of the distributor space 26.

Figure 4:
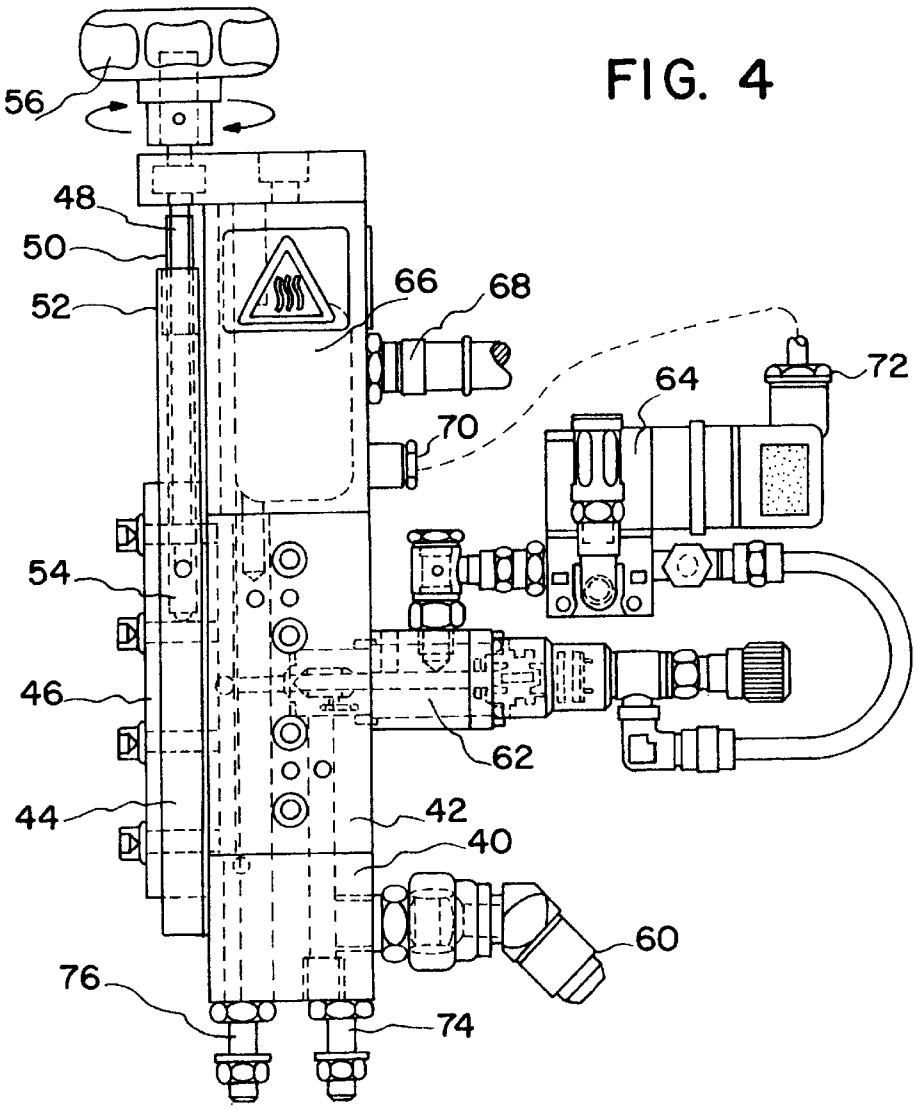
FIG. 4 shows a view of an actual structural embodiment of the slot nozzle with all the connections.

An actual embodiment of the slot nozzle consists of more than two elements, as can be seen from FIG. 4. The slot nozzle illustrated there has a basic body 40, which together with a mouth plate 42 forms a unit corresponding to the second slider element 20 of FIGS. 1 to 3. A mouth part 44 which is attached displaceably to the basic body 40 by means of a pressure piece 46 corresponds to the first slider element 10 of FIGS. 1 to 3. In order to displace the mouth part 44 relative to the unit consisting of basic body 40 and mouth place 42, a spindle 48 which is mounted in a stationary manner with respect to the basic body 40 engages with its thread 50 in a corresponding mating thread 52 in a bore 54 in the mouth part 44.

The mouth part 44 can be displaced relative to the basic body 40 and the mouth plate 42 to the right or to the left with respect to FIG. 4 by turning a turning knob 56 located on the spindle 48.

In addition to the elements named, the slot nozzle in FIG. 4 has additional elements which are linked to its intended use. A hose connection 60 for supplying adhesive is attached to the basic body 40. The further supply of adhesive to the mouthpiece opening of the slot nozzle is effected through bores in the basic body 40, one of which can be closed with the aid of a pneumatic valve 62 with magnetic auxiliary valve 64 which is attached to the basic body 40, in order to interrupt the flow of adhesive. Finally, an electric heating means 66 for heating the entire slot nozzle is provided for the use of hot-melt adhesive. An electrical connection 68 is attached to the electric heating means 66, by means of which connection both the electricity required for heating and the control signals for the magnetic auxiliary valve 64 are supplied. In order to pass on the control signals for the magnetic auxiliary valve 64 thereto, two electrical connections 70 and 72 are provided. Two threaded bolts 74 and 76 on the basic body 40 serve for mounting the slot nozzle on a support.

Figure 5:
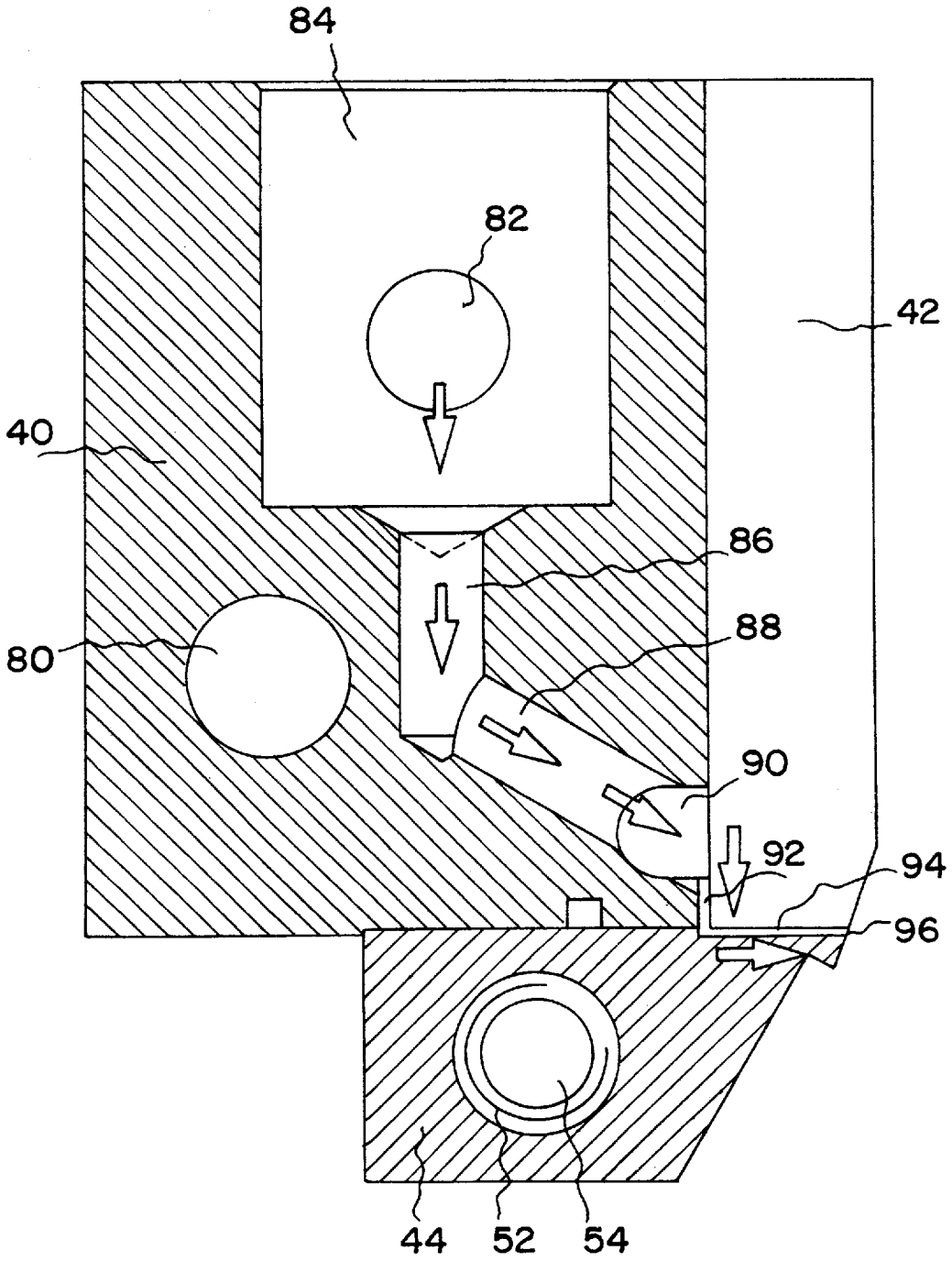
FIG. 5 shows a section through the slot nozzle of FIG. 4.

The elements of the slot nozzle which are significant in connection with the invention are the basic body 40, the mouth plate 42 and the mouth part 44. These three elements are shown in section in FIG. 5. The basic body 40 is equipped with a plurality of bores 80 to 88, of which the bore 80 serves for receiving a heating element, whereas bores 82 to 88 serve for supplying adhesive to the distributor space 90. The valve 62 is screwed into the bore 84. The supply of adhesive can therefore be interrupted in the region of the bore 84, so that the adhesive can no longer pass from the bore 82 into the bores 86 and 88. A distributor space 90 consists of a groove in the basic body 40, which extends at right-angles to the plane of the drawing of FIG. 5. The groove is covered on one side by the mouth plate 42, so that the distributor space 90 only has a narrow, slot-shaped exit 92 on the underside of the unit consisting of the basic body 40 and mouth plate 42.

On the underside of the basic body 40, the mouth part 44 adjoins the basic body 40 hermetically. The bore 54 in the mouth part 44 with the internal thread 52 for receiving the threaded spindle 48 can be seen. The mouth part 44 is displaceable relative to the basic body 40 and the mouth plate 42 at right-angles to the plane of the drawing of FIG. 5 with the aid of the spindle 48 (not shown). Between the mouth plate 42 and the mouth part 44, a slot-shaped cavity 94 is formed by a cutout of the upper side of the mouth part 44 which serves as a sliding surface, which cavity communicates on the entry side with the exit 92 of the distributor space 90, and on the exit side ends in a slot-shaped mouthpiece opening 96. The flow of adhesive is indicated by arrows in FIG. 5.

Figure 6:
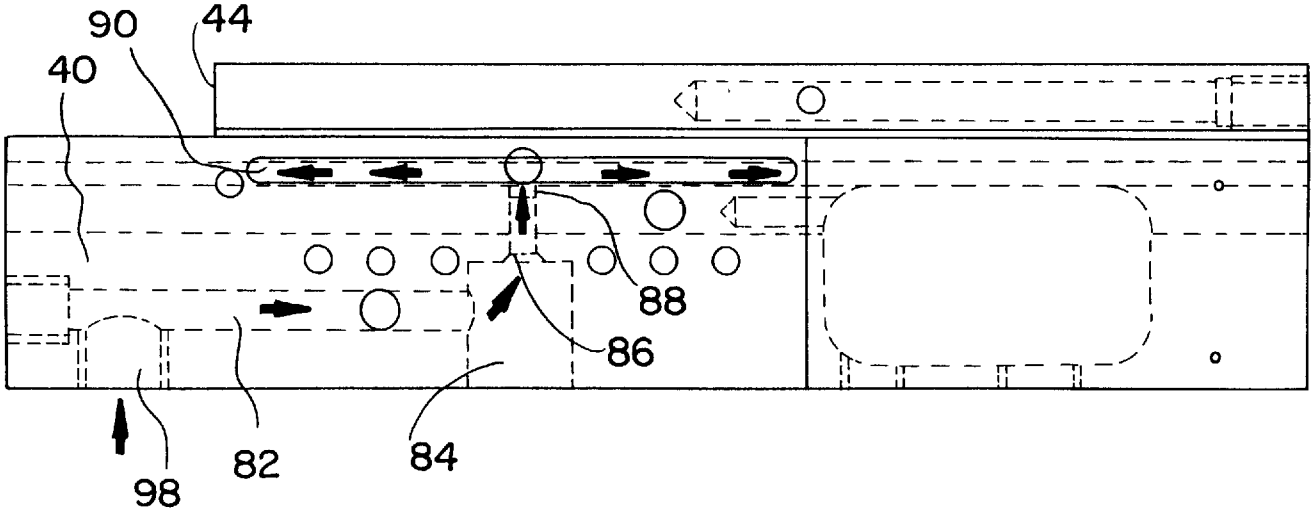
FIG. 6 shows a view of the slot nozzle for the maximum width of the mouthpiece opening.

In FIG. 6, arrows indicate how the adhesive flows through the unit consisting of the basic body 40 and the mouth part 44 and is distributed. The mouth plate 42 is not shown in this drawing, so that the groove for the distributor space 90 is revealed open. The adhesive enters the basic body 40 through the bore 98 for the hose connection 62, is passed from the bore 82 to the bore 84 for the pneumatic valve 64, and then through the bores 86 and 88 into the groove for the distributor space 90. The adhesive passes through the slot-shaped exit opening 92 of the distributor space 90 into the cavity 94 between the basic body 40 and the mouth part 44, which is at its maximum width in FIG. 6.

The cavity 94 is formed in a cutout in the mouth part 44 between the mouth plate 42 and the mouth part 44. In this case, the cutout is arranged relative to the sliding surface of the mouth part 44 exactly as is apparent from FIGS. 1 to 3 in the simple variant of the slot nozzle. The projection which engages in the cutout to define the cavity is a part of the sliding surface on the underside (with reference to FIG. 5) of the unit consisting of basic body 40 and mouth plate 42. The sliding surface of the unit consisting of basic body 40 and mouth plate 42 is formed in this case by the entire underside (relative to FIG. 5) of the mouth plate 42 and that partial surface on the underside of the basic body 40 which lies on the sliding surface of the mouth part 44. The projection is a part of the basic body 40.

Figure 7:
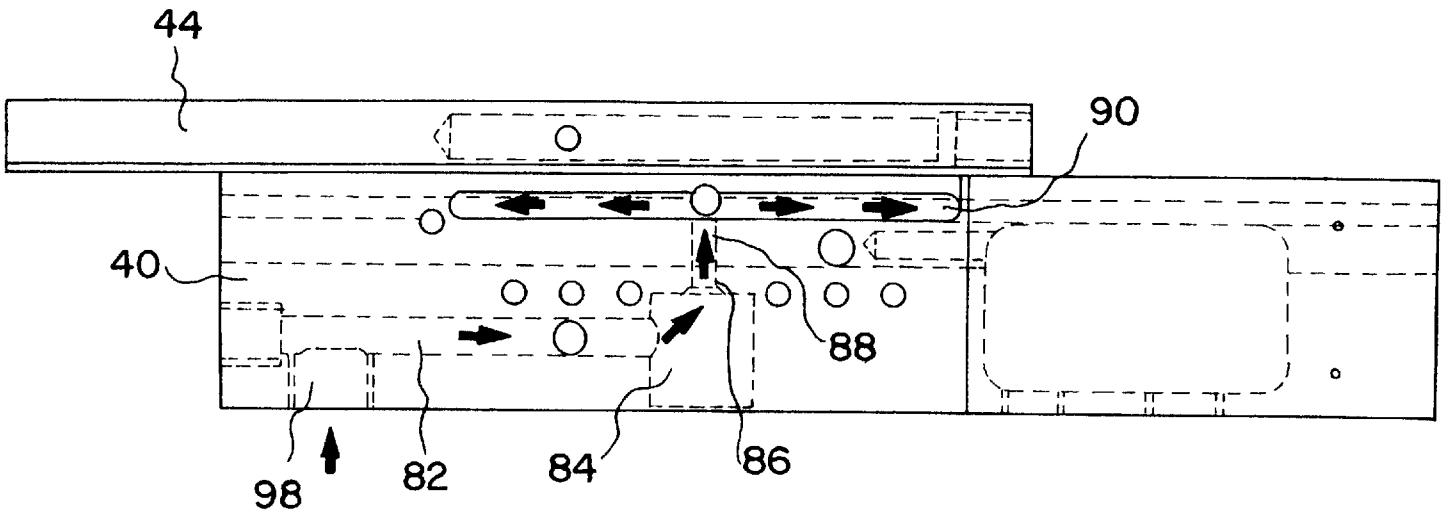
FIG. 7 shows a view corresponding to FIG. 6 for the minimum width of the mouthpiece opening.

Compared with FIG. 6, in FIG. 7 only the mouth part 44 is displaced relative to the basic body 40. Due to the displacement, the cavity between the basic body 40 and the mouth part 44 is reduced to its minimum width, as is indicated in the drawing. The adhesive therefore emerges from the slot nozzle only in the region indicated by the dimension lines. The cavity and with it the mouthpiece opening of the slot nozzle can be adjusted continuously between the maximum width of the cavity given in FIG. 6 and the minimum width of the cavity illustrated in FIG. 7.

Various other modifications can be made in the apparatus shown and described herein without departing from the scope of the invention.

I claim:

1. A slot nozzle with a nozzle inlet and a mouthpiece opening, for applying flowable material to a surface, the nozzle comprising:

a first and second slider element which are displaceable relative to one another in a predetermined direction, the first slider element having a first sliding surface and the second slider element having a second sliding surface;

the first and second sliding surfaces areally contacting each other;

the first slider surface having a cutout and the second sliding surface having a projection which engages in the cutout;

the slider elements forming a cavity between them which is defined by a base and by lateral surfaces of the cutout, an end face of the projection and the second sliding surface;

the surfaces of both slider elements defining the cavity lying against one another in sealing relationship;

the cavity communicating with the nozzle inlet on an outer surface of one of the slider elements;

the cavity having a slot-shaped opening on a side located parallel to the direction of displacement and between the two slider elements, which opening forms the mouthpiece opening of the slot nozzle and the dispensing width of which is adjustable by displacing the slider elements relative to each other; and a distributor space disposed between the nozzle inlet and the cavity, which space communicates with the nozzle inlet and adjoins the cavity and the length of which in the direction of displacement corresponds to the maximum length of the cavity.

2. A slot nozzle according to claim 1, wherein the distributor space is formed by a recess starting from the cavity in one of the slider elements, the side of which is open at the maximum dispensing width and is partially closed at smaller dispensing widths.

3. A slot nozzle according to claim 1, wherein the distributor space communicates with the nozzle inlet via a feed line which opens onto that end of the distributor space which is first covered when the slider elements are displaced relative to each other starting from their position at maximum dispensing width.

4. A slot nozzle according to claim 3, wherein the feed line opens onto the end of the distributor space remote from the projection.

5. A slot nozzle according to claim 1, wherein the distributor space is formed by a recess in the sliding surface of the second slider element and extends in the direction of displacement starting from the projection.

6. A slot nozzle according to claim 1, wherein the sliding surfaces are flat.

7. A slot nozzle according to claim 6, wherein the base of the cutout is flat and runs parallel to the sliding surfaces.

8. A slot nozzle according to claim 1, wherein the height of the mouthpiece opening at right-angles to the direction of displacement is constant.

9. A slot nozzle according to claim 1, wherein the first slider element is attached by means of a pressure piece to the second slider element so as to be displaceable.

10. A slot nozzle with a nozzle inlet and a mouthpiece opening, for applying flowable material to a surface, the nozzle comprising:

a first, one-piece slider element and a second slider element displaceable relative to one another in a predetermined direction, the first slider element having a first, rectangular sliding surface and the second slider element having a second sliding surface;

the first and second sliding surfaces areally contacting each other;

the first slider surface having a cutout located in a corner of the first slider surface, so that the cutout has two adjoining side faces and a base and is laterally open on two abutting side faces of the first slider element and the second sliding surface having a projection which engages in the cutout;

the slider elements forming a cavity between them which is defined by a base and by lateral surfaces of the cutout, an end face of the projection and the second sliding surface;

the surfaces of both slider elements defining the cavity lying against one another in sealing relationship;

the cavity communicating with the nozzle inlet on an outer surface of one of the slider elements; and the cavity having a slot-shaped opening on a side located parallel to the direction of displacement and between the two slider elements, which opening forms the mouthpiece opening of the slot nozzle and the dispensing width of which is adjustable by displacing the slider elements relative to each other.

11. A slot nozzle with a nozzle inlet and a mouthpiece opening, for applying flowable material to a surface, the nozzle comprising:

a first and second slider element which are displaceable relative to one another in a predetermined direction, the first slider element having a first sliding surface and the second slider element having a second sliding surface;

the first and second sliding surfaces areally contacting each other;

the first slider surface having a cutout and the second sliding surface having a projection which engages in the cutout;

the slider elements forming a cavity between them which is defined by a base and by lateral surfaces of the cutout, an end face of the projection and the second sliding surface;

the surfaces of both slider elements defining the cavity lying against one another in sealing relationship;

the cavity communicating with the nozzle inlet on an outer surface of one of the slider elements;

the cavity having a slot-shaped opening on a side located parallel to the direction of displacement and between the two slider elements, which opening forms the mouthpiece opening of the slot nozzle and the dispensing width of which is adjustable by displacing the slider elements relative to each other; and wherein the second slider element which bears the projection consists of two partial elements.

12. A slot nozzle according to claim 11, wherein the first partial element has the nozzle inlet and a groove for the distributor space which communicates therewith.

13. A slot nozzle according to claim 12, wherein the groove for the distributor space is limited on one side by a lateral surface of the second partial element.

14. A slot nozzle with a nozzle inlet and a mouthpiece opening, for applying flowable material to a surface, the nozzle comprising:

a first and second slider element which are displaceable relative to one another in a predetermined direction, the first slider element having a first sliding surface and the second slider element having a second sliding surface;

the first and second sliding surfaces areally contacting each other;

the first slider surface having a cutout and the second sliding surface having a projection which engages in the cutout;

the slider elements forming a cavity between them which is defined by a base and by lateral surfaces of the cutout, an end face of the projection and the second sliding surface;

the surfaces of both slider elements defining the cavity lying against one another in sealing relationship;

the cavity communicating with the nozzle inlet on an outer surface of one of the slider elements;

the cavity having a slot-shaped opening on a side located parallel to the direction of displacement and between the two slider elements, which opening forms the mouthpiece opening of the slot nozzle and the dispensing width of which is adjustable by displacing the slider elements relative to each other; and wherein a threaded spindle is attached to the second slider element which spindle engages in the first slider element, so that the latter can be displaced linearly with respect to the second slider element by turning the threaded spindle.

* * * * *